United States Patent [19]

Merjan

[11] Patent Number: 4,725,167

[45] Date of Patent: Feb. 16, 1988

[54] PILE DRIVING

[76] Inventor: Stanley Merjan, 16 Beacon Dr., Port Washington, N.Y. 11050

[21] Appl. No.: 830,724

[22] Filed: Feb. 19, 1986

[51] Int. Cl.[4] ..... E02D 7/02

[52] U.S. Cl. ..... 405/233; 405/253; 405/232; 405/245

[58] Field of Search ..... 173/1, 128, 131, 132; 405/232, 233, 237, 239, 242, 245, 253, 255, 246

[56] References Cited

U.S. PATENT DOCUMENTS

| | | | |
|---|---|---|---|
| 2,830,443 | 4/1958 | Burrell | 405/237 |
| 3,295,332 | 1/1967 | Dougherty | 405/255 |
| 3,327,483 | 6/1967 | Gibbons | 405/245 |
| 3,913,337 | 10/1975 | Merjan | 61/50 |
| 3,984,992 | 10/1976 | Merjan | 61/53.72 |
| 4,293,242 | 10/1981 | Merjan | 405/239 |
| 4,462,716 | 6/1984 | Merjan | 405/233 |

FOREIGN PATENT DOCUMENTS

| | | | |
|---|---|---|---|
| 962449 | 9/1982 | U.S.S.R. | 405/253 |

*Primary Examiner*—Paul A. Bell
*Assistant Examiner*—James L. Wolfe
*Attorney, Agent, or Firm*—Abner Sheffer

[57] ABSTRACT

A screw-on splicer for use in driving composite pipe-shell piles and a screw-on tip for shell piles. Each has an outer diameter at least about 2 inches greater than the O.D. of the shell. An enlarged tip for shell piles, comprises a mass of concrete encased in a non-tapered corrugated shell and having a corrugated shell socket for receiving the shell stem.

5 Claims, 5 Drawing Figures

PILE DRIVING

One aspect of this invention relates to the driving of composite pipe-shell piles. Such composite piles comprise: (a) a lower stem portion of pipe (of substantially uniform diameter along its length) capable of receiving and transmitting pile-driving blows, (b) an upper stem portion of corrugated shell (also of substantially uniform diameter along its lenth) incapable of withstanding such blows, and (c) a splicer joining the two stems. The corrugated shell is typically made of steel having a wall thickness of about 1/32 inch to 1/16 inch (such as 14, 16 or 18 U.S. Standard gage) which is helically corrugated. Typically the valleys of the corrugations are about ½ inch deep and the corrugations are about 2 inches wide (measured from one peak to the next) with a helical pitch of about ¾ turn per foot of axial length. The shell is thus susceptible to expansion and concentration both radially and axially.

Usually there is a suitable closure element such as a "boot" at the bottom of the pipe stem portion of the pile; this prevents the soil and/or water from entering the pipe stem during driving. The boot may, for example, be a flat plate, welded to the bottom of the pipe, or a fabricated point.

These composite pipe-shell piles are used, for example, when the pile must be driven to such a great depth that the use of a long shell stem is impracticable. Many pile driving rigs are not capable of driving shell stems over 60 feet long, using correspondingly long mandrels; furthermore longer mandrels are less rigid and their use can result in damage during handling and driving. Current practice is to drive a lower, pipe, portion of the stem in the usual manner (by blows applied to the top of the pile) until the top of the pipe is at or near ground level and then to fit, onto the top of the pipe, a splicer (described below) to which the bottom of the upper, shell portion of the stem has been welded. The welding may be done at the pile driving site or in a fabricating shop.

Composite pipe-shell piles are also used in cases where the pile does not have to be driven to great depth, when the ground contains obstructions which could damage a shell stem. Here the use of the heavy-wall pipe as the lower portion of the stem will often overcome the obstructions with little or no damage to the stem; once the pile has been driven past the obstructions, a shell stem may be used safely for the rest of the length of the pile.

In the accompanying drawings.

Figure 1:
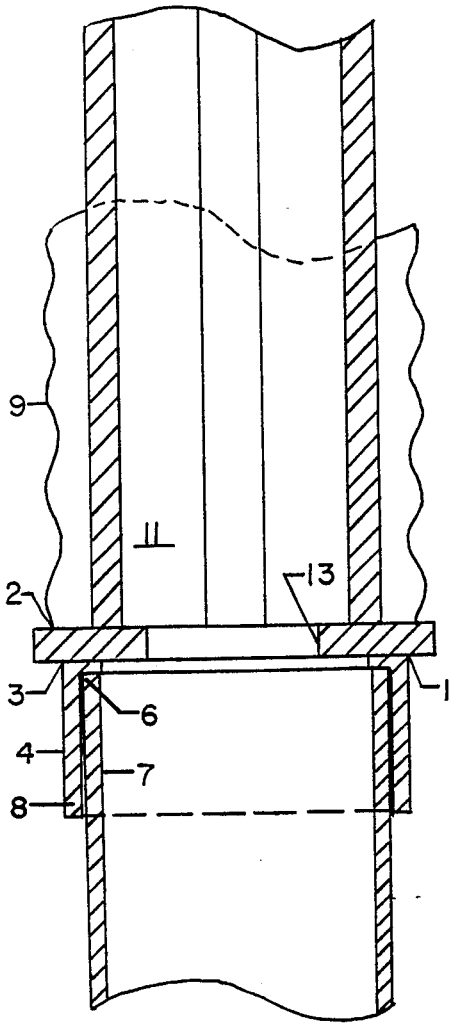
FIG. 1 is a cross-sectional side view of the use of a conventional splicer in the driving of a composite pipe-shell pile with an expanding mandrel.
Figure 2:
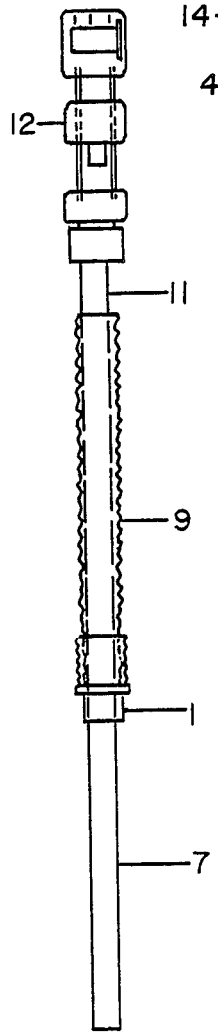
FIG. 2 is a side view of the driving of a conventional composite pipe-shell pile with an expanding mandrel.
Figure 3:
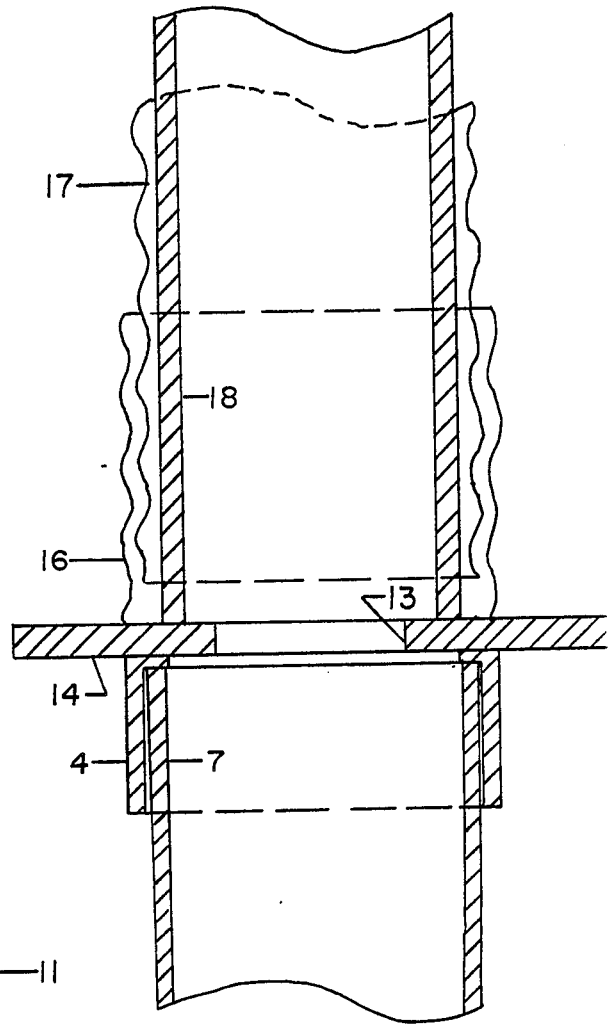
FIGURE 3 PRIOR ART
FIG. 3 is a cross-sectional side view of the use of the novel splicer in the driving of a composite pipe-shell pipe with a pipe mandrel.
Figure 4:
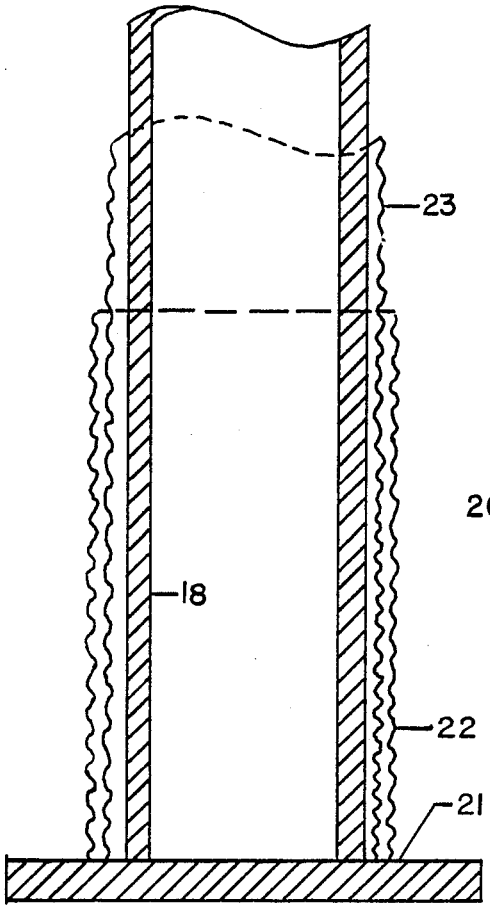
FIG. 4 is a cross-sectional side view of the driving of a shell pile having a screw-on boot.

The conventional splicer 1 (FIG. 1) comprises a plate 2 to the bottom of which there is welded (as at 3) a drive sleeve 4 having an internal circumferential shoulder 6 adapted to abut against the upper end of the pipe 7, and a depending body portion 8 to fit around the pipe, with a drive fit.

Conventionally the shell stem 9 is, as previously indicated, welded to the top of the plate 2 and the sleeve 4 is fitted onto the partially driven pipe stem 7. Then an expanding mandrel 11 is inserted into the shell stem so that the bottom of the mandrel rests on the plate and the sides of the mandrel engage the inside of the shell; the mandrel is preferably of the type described in U.S. Pat. No. 3,984,992. The pile driving hammer 12 applies its blows to the mandrel which transmits the driving force to the plate and thus to the pipe stem.

After the pile has been fully driven, the pile stems are filled with concrete poured from above. The plate 2 has a central hole 13 to permit the concrete to flow from the shell stem into the pipe stem.

The pipe stem, plate, sleeve and shell stem are circular in horizontal cross-section, and the outside diameter (O.D.) of the shell stem is usually substantially equal to or somewhat larger than, the O.D. of the pipe stem. The body portion 8 of the sleeve is about one half inch to one inch thick. The O.D. of the plate is about ½ to one inch larger than the O.D. of the shell stem.

One aspect of the invention employs a splicer which is made up of a drive sleeve 4 of conventional type (such as described above), a plate 14 secured (as by welding) to the top of the drive sleeve, and, secured to the top of the plate (as by welding), a shell stub 16 which is a short length of corrugated shell. The internal diameter of the stub 16 is slightly larger (e.g. about ⅛ inch larger) than the external diameter of the shell stem 17 which is to be used for the pile. The length of the stub 16 is up to about 3 feet. To use this splicer, the shell stem is merely screwed into the stub. This is preferably done before the splicer is fitted over the top of the partially driven pipe stem, but it may also be carried out while the splicer is on the partially driven pipe stem. Then a pipe mandrel 18 is inserted into the shell stem with the bottom of the mandrel resting on the plate. Preferably the mandrel is of the type shown in U.S. Pat. No. 4,462,716.

The diameter of the plate 14 used in this invention is at least about 2 inches greater than the O.D. of the shell stub and correspondingly greater than the O.D., of the shell stem. When this plate is driven through the ground by the blows from the mandrel it forms a hole (in the ground) whose diameter is sufficiently larger than the shell O.D. that friction between the ground and the shell stem (during the driving of the latter) is greatly reduced or substantially eliminated, thus reducing the possibility of damage to the shell stem during the driving and making it feasible to use a pipe mandrel instead of an expanding mandrel. The resulting annular space around the shell stem may fill more loosely with earth thereafter as a result of caving in of the surrounding soil (particularly, in granular soils, e.g., fine sand to gravel), naturally and as augmented by the vibration associated with the driving of this and subsequent piles. In cohesive soils such as slits and clays there may be little or no such caving in of the soil, depending on its stiffness. Any annular space remaining at completion of the driving may be filed directly by the placement of soil from above.

Examples of dimensions of composite piles according to this invention are:

| | Pile A | Pile B | Pile C | Pile D |
|---|---|---|---|---|
| Pipe stem O.D. (inches) | 8⅝ | 10¾ | 12¾ | 14 |

-continued

| | Pile A | Pile B | Pile C | Pile D |
|---|---|---|---|---|
| Pipe wall thickness (inches) | 0.25 | 0.365 | 0.375 | 0.50 |
| Pipe stem length (feet) | 20–60 | 20–60 | 20–80 | 20–80 |
| Plate O.D. (inches) | 12 | 15 | 20 | 24 |
| Stub length (inches) | 12 | 16 | 20 | 24 |
| Shell stem O.D. (inches) | 10 | 12 | 16 | 19 |
| Shell stem length (feet) | 10,15 or 20 to 40 | 10,15 or 20 to 60 | 10,15 or 20 to 60 | 10,15 or 20 to 60 |

Another aspect of this invention relates to the driving of shell piles, particularly relatively short shell piles (e.g. about 10 to 30 feet in length), driven by means of a pipe mandrel impinging on a boot at the base of the shell stem (which is of substantially uniform diameter along its length. Conventionally, the boot is a flat steel plate and is welded to the bottom of the shell. In accordance with this aspect of the invention the boot is a steel plate 21 having welded thereto (e.g. in a fabricating shop) a short corrugated shell stub 22 whose internal diameter is slightly larger (e.g., about ½ inch larger) than the external diameter of the shell stem 23 so that the lower end of the corrugated shell stem can be readily screwed into the correspondingly corrugated stub. In use, long corrugated shells (which are conventionally supplied in lengths of up to 60 feet) may be cut to the requisite stem length and then quickly fitted to the stub of the boot at the site, thus reducing costs for shell waste and for welding at the pile driving site.

The plate 21 has a diameter somewhat larger than that of the stub (e.g. 2, 3 or 4 inches or more greater that the stub diameter) to reduce frictional effects on the stem during driving and to increase the bearing area at the base of the pile.

Examples of dimensions of piles of this aspect of the invention are:

| | Pile E | Pile F | Pile G | Pile H |
|---|---|---|---|---|
| Shell O.D. (inches) | 8 | 10 | 12 | 16 |
| Stub length (inches) | 12 | 12 | 18 | 18 |
| Plate diameter (inches) | 12 | 14 | 16 | 21 |

Figure 5:
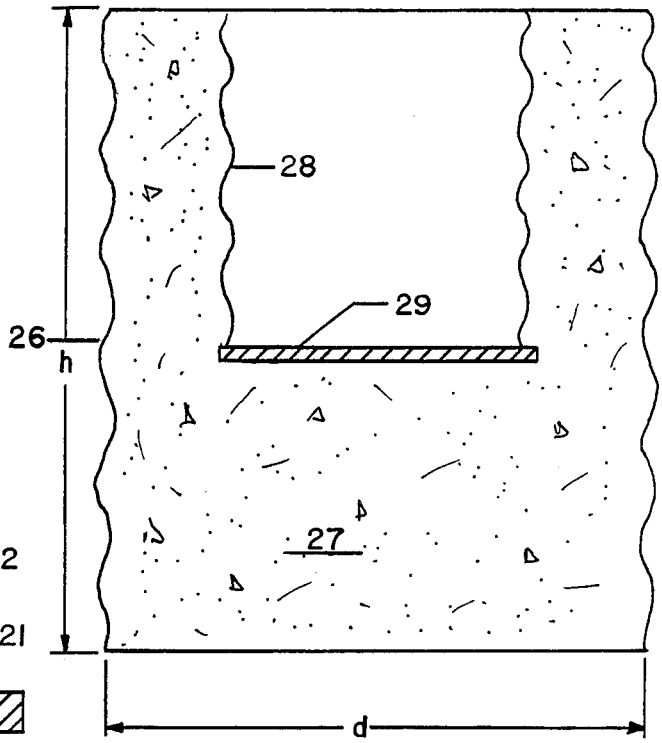
FIG. 5 is a cross-sectional side view of an enlarged tip.

Another aspect of the invention relates to a corrugated shell pile having an enlarged tip. The tip comprises a piece of large diameter untapered corrugated shell 26 having a ratio of diameter ("d" FIG. 5) to height ("h" in FIG. 5) of about 1:1 to 1:2, filled with concrete 27 except for a central socket formed by a relatively short length, or stub, of corrugated shell 28 suitably closed at its bottom (as by means of a plate 29) positioned in the upper central portion of the larger diameter piece. The large shell 26 is of substantially uniform diameter along its height, as is the stub 28. The concrete should contain suitable reinforcement; this is preferably fibrous reinforcement such as more or less uniformly distributed high tensile strength fibers, e.g. steel fibers of say 1/100 inch diameter, 1 to 2 inches long, occupying a small proportion (such as about 2%) of the total volume of the concrete. When this prefabricated tip is moved to the construction site, the stub serves as a socket into which a shell stem may be screwed. The pile may then be driven in the manner described in U.S. Pat. Nos. 3,913,337, 4,462,716, 3,984,992 or 4,293,242. This tip is particularly useful for driving of piles that penetrate through cohesive soils (e.g. clay) but it may also be employed in granular soils.

Examples of dimensions of tips according to this aspect of the invention are:

| | Tip 1 | Tip 2 | Tip 3 | Tip 4 |
|---|---|---|---|---|
| O.D. of outer shell (inches) | 14 | 14 | 16 | 19 |
| Height of outer shell (inches) | 14 | 18 | 18 | 24 |
| O.D. of stub (inches) | 8 | 10 | 10 | 12 |
| Depth of socket (inches) | 7 | 9 | 6 | 12 |

It will be understood that in each of the described embodiments the shell stem and shell stub and the large diameter piece of shell are of helically corrugated shell as described earlier and that each of the shell stems is filled with concrete after it has been driven to the desired depth.

It is understood that the foregoing detailed description is given merely by way of illustration and that variations may be made therein without departing from the spirit of the invention.

I claim:

1. Process for producing in the ground a driven composite pile having (a) a lower pipe stem having an upper part having a top, said lower pipe stem being capable of withstanding pile driving blows applied to said top and (b) an upper corrugated shell stem incapable of withstanding pile driving blows, said corrugated shell stem having a lower end, which process comprises driving said lower pipe stem into the ground fitting to said top of said lower pipe stem a splicer, said splicer comprising a plate having a top face and a bottom face, an integral body portion depending from said plate and surrounding said upper part of said pipe stem and, welded to said top face of said plate, an upwardly extending corrugated shell stub up to about three feet long, screwing the lower end of said upper corrugated shell stem to said shell stub after driving said lower pipe stem into the ground, placing a non-expanding pipe mandrel into said shell stem with the bottom of said mandrel resting on said plate, striking pile-driving blows on the top of said mandrel to drive said composite pile into the ground, and filling said shell stem and pipe stem with concrete from above, said shell stub having corrugations corresponding to the corrugations of said shell stem and having an internal diameter slightly larger than the outer diameter of said shell stem, said shell stem being of substantially uniform diameter along its height, said plate having an outer diameter at least about 2 inches greater than the outer diameter of said shell stub.

2. Process as in claim 1 including the step of providing, as said shell stem, a shell stem whick has a length of at least about 10 feet and an outer diameter of about 10 to 20 inches.

3. Process for producing in the ground a driven pile which comprises providing a corrugated shell stem having a lower end providing a plate having a top surface and having welded to said top surface an upwardly extending corrugated shell stub up to about 3 feet long, said plate having an outer diameter at least about 2 inches greater than the outer diameter of said stub, screwing said lower end of said corrugated shell stem into said shell stub, providing a mandrel having a bottom and a top and placing said mandrel into said shell stem with said bottom of said mandrel resting on said plate, striking pile-driving blows on the top of said mandrel to drive said pile into the ground with the plate being at the base of the pile and filling said shell stem with concrete, said shell stub having corrugations corresponding to the corrugations of said shell stem and having an internal diameter slightly larger than the outer diameter of said shell stem.

4. Process as in claim 4 in which said mandrel is a non-expanding pipe mandrel.

5. A tip for a corrugated shell stem pipe having a lower end, said tip comprising a concrete-filled non-tapered piece of corrugated stell shell having a ratio of diameter to height of about 1:1 to 1:2, containing concrete filling having an upper portion, and centrally disposed in said upper portion of the concrete filling of said tip, an unfilled length of corrugated shell stub having a diameter of up to about 7/10 the diameter of said piece and forming a socket into which the lower end of a corrugated shell pile stem can be screwed to secure said stem to said tip, said non-tapered piece of corrugated shell having a corrugated outer surface, said tip having a substantially vertical corrugated outer surface, the latter surface being the outer surface of said non-tapered piece of corrugated shell.

* * * * *